United States Patent [19]

Boyer

[11] 4,400,922

[45] Aug. 30, 1983

[54] PANEL MOUNTING CLIP ASSEMBLY AND WALL OR ROOF STRUCTURE UTILIZING THE SAME

[75] Inventor: Keith D. Boyer, Connersville, Ind.

[73] Assignee: H. H. Robertson Company, Pittsburgh, Pa.

[21] Appl. No.: 249,062

[22] Filed: Mar. 30, 1981

[51] Int. Cl.[3] ..... E04B 1/62

[52] U.S. Cl. ..... 52/394; 52/395; 52/478; 52/529; 52/530; 52/536; 52/543; 52/544; 52/546

[58] Field of Search ..... 52/394, 395, 543, 544, 52/546, 529, 530, 536

[56] References Cited

U.S. PATENT DOCUMENTS

| | | | |
|---|---|---|---|
| 2,742,116 | 4/1956 | Fitzgerald | 52/588 |
| 2,765,887 | 10/1956 | Horowitz | 52/522 |
| 3,293,819 | 12/1966 | Heirich | 52/588 |
| 3,296,751 | 1/1967 | Heirich | 52/588 |
| 3,858,373 | 1/1975 | Day et al. | 52/713 |
| 3,982,373 | 9/1976 | Wilson et al. | 52/588 |
| 4,025,019 | 5/1977 | Jacobsen | 52/713 |
| 4,193,247 | 3/1980 | Heckelsberg | 52/713 |
| 4,213,282 | 7/1980 | Heckelsberg | 52/404 |

FOREIGN PATENT DOCUMENTS

| | | | |
|---|---|---|---|
| 447814 | 5/1949 | Italy | 52/543 |

*Primary Examiner*—Alfred C. Perham
*Assistant Examiner*—Mark J. Sofia
*Attorney, Agent, or Firm*—G. E. Manias

[57] ABSTRACT

A panel mounting clip assembly is adapted to connect the intermediate longitudinal ribs of panel members and the rib-like joints between adjacent ones of the panel members to panel support members. The clip assembly comprises a base member that is fastened to the panel support member and a top clip that is frictionally engaged with interior surfaces of the ribs or joints to accommodate thermal expansion and contraction of the panels. The top clip-to-base member connection provides for movement of the top clip transversely of the length of the panel member thereby to accommodate rib-to-clip and joint-to-clip misalignments. The top clip-to-base member connection also provides for limited universal movement of the top clip relative to the base member to accommodate any inherent minor distortions in the profile of the intermediate ribs or the panel elements of the rib-like joint. A roof or wall structure utilizing the panel mounting clip assembly is described. A joint retention clip for maintaining the elements of the rib-like joint in assembled relation in the region between adjacent panel support members is described.

27 Claims, 25 Drawing Figures

PANEL MOUNTING CLIP ASSEMBLY AND WALL OR ROOF STRUCTURE UTILIZING THE SAME

BACKGROUND OF THE INVENTION

1. Field of the Invention

This invention relates to concealed fasteners for roof and wall structures, and more particularly to a panel mounted clip assembly used at the joints between adjacent panel members and at the intermediate ribs of each panel member, to secure the panel members to panel support members.

2. Description of the Prior Art

Roof structures are known wherein a plurality of panel members are erected in side-by-side relation and secured to panel support members. Adjacent panel members are connected by interlocking marginal edges to form joints. The joints may be self-closing or may be closed by seaming devices. The prior art discloses many types of concealed fastening devices which interfit with the joints and secure the panel members to the panel support members.

One-piece clips are known which are rigidly secured to the panel support member and which are interfitted with the marginal edges of adjacent panel members at the joints, see for example U.S. Pat. No. 3,982,373 (WILSON et al).

Two-piece clips are known which comprise a base member, a top member, and a slideable connection therebetween allowing the top member to move with the panels during thermal expansion and contraction thereof. In one two-piece clip, the slideable connection resides within the interfitted marginal edges of the panel members, see U.S. Pat. No. 3,858,373 (DAY et al). In another two-piece clip, the slideable connection resides below the interfitting marginal edges of the panels. The top portion of the two-piece clip may be bent resiliently to some extent laterally of the base member. The lateral bending of the top portion appears to be an attempt to accommodate slight misalignment of the interfitted marginal edges of the panels relative to the base member. Such a two-piece clip is disclosed in U.S. Pat. Nos. 4,193,247 and 4,213,282 issued to HECKELSBERG.

Prior art two-piece clips have been used at the panel joints. The panel members have limited cover widths, e.g., 24 inches or less. Most panel members are made by roll-forming operations to established finite tolerances. Where the finite tolerances are not maintained or, conversely, where the two-piece clips are not erected in precise spaced-apart relation, the panel joints are not readily alignable with the two-piece clips. The joint-to-clip misalignment may reduce the hold-down capacity of the clips and may introduce undesirable stresses which could degrade the weather-tightness of the joint and hinder the thermal expansion and contraction of the panel members.

SUMMARY OF THE INVENTION

The principal object of this invention is to provide a panel mounting clip assembly used at the joint between adjacent panel members and at intermediate ribs presented by the panel members, to firmly secure the panel members to a panel support member.

Another object of this invention is to provide a panel mounting clip assembly which accommodates thermal movement of the panel members.

A further object of this invention is to provide a panel mounting clip assembly which accommodates joint-to-clip and rib-to-clip misalignment—the misalignment arising from inexact rib spacing resulting from variations in panel dimensions or from imprecise spacing of the clip assemblies on the panel support member or from both of the above causes.

Still another object of this invention is to provide a panel mounting clip assembly having a self-centering clip component thereby allowing more relaxed production tolerances and erection tolerances.

A still further object of this invention is to provide a roof or wall structure incorporating the present panel mounting clip assemblies and using panels having greater cover widths thereby taking advantage of the accompanying economies accorded by the larger width panels.

The present invention provides a panel mounting clip assembly for inter-connection with a longitudinal rib of a panel member and for attaching the panel member to a panel support member. The clip assembly comprises a top clip and a base member. The top clip has an upper wall. Clamping wings depend from opposite sides of the upper wall and terminate in clamping edges engageable with interior surfaces extending lengthwise of the longitudinal rib. Connecting wings depend from opposite ends of the upper wall and include terminal flanges disposed below the level of the clamping edges and angularly presented relative to the connecting wings. The base member is adapted to be fastened to a support member in fixed position relative thereto. The base member includes spaced-apart opposite faces extending transversely of the clamping wings. Guide means associated with the opposite faces receive the terminal flanges thereby connecting the top clip to the base member in movable relationship to provide for movement of the top clip transversely of the length of the longitudinal rib. Stop means is provided which limits movement of the top clip relative to the base member.

As in prior art clip assemblies, the present clip assembly accommodates longitudinal movement of the panel members resulting from thermal expansion and contraction. The present clip assembly—differing from prior art clip assemblies—accommodates joint-to-clip and rib-to-clip misalignment without reducing the hold-down capacity of the clips and without introducing undesirable stresses. Therefore the present clip assembly exhibits positive clip movement in a direction only attempted but not really achieved by prior art clip assemblies.

The present invention also provides a roof or wall structure in which the present panel mounting clip assemblies are used in conjunction with relatively wide panel members thereby taking advantage of the economies associated with larger width panel members. The panel members include intermediate longitudinal ribs and marginal longitudinal edges which are configured to simulate a longitudinal rib when adjacent panel members are assembled in side-by-side overlapped relation.

DESCRIPTION OF THE PREFERRED EMBODIMENT(S)

Figure 1:
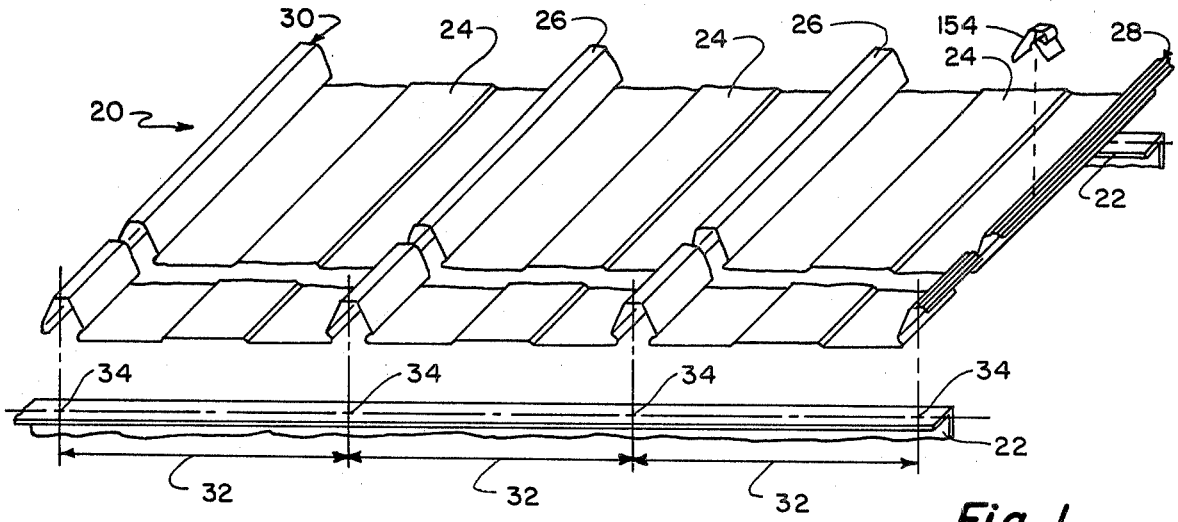
FIG. 1 is a fragmentary isometric view, in exploded form, illustrating relationships between a panel member and panel support members.

FIG. 1 illustrates a panel member 20 positioned to extend between adjacent panel support members 22. The panel member 20 is profiled to present plural panel webs 24, longitudinal ribs 26 each connecting adjacent ones of the panel webs 24, and partial ribs 28, 30 along the opposite longitudinal edges of the panel 20. When adjacent ones of the panels 20 are assembled in side-by-side overlapped relation, the partial ribs 28, 30 of the adjacent panels 20 simulate one of the longitudinal ribs 26, as will hereinafter be described.

The panel member 20 is fabricated by roll forming operations to establish finite tolerances. Normally, the longitudinal ribs 26 and the partial ribs 28, 30 will be equidistantly spaced as indicated by the rib spacings 32. The rib spacings 32 also determine anchor sites 34 at which each of the ribs 26 and partial ribs 28, 30 are secured to the panel support members 22. The erection crew normally has knowledge of the rib spacing 32 and will secure the concealed fastener devices at the anchor sites 34. The actual spacing of the ribs 26 and partial ribs 28, 30 normally is not measured in the field. Instead the erection crew relies on the specified rib spacings. Thus in the normal erection procedure, there are three instances of possible spacing errors. These instances include (1) the established rib spacing is not maintained during manufacture of the panel member 20; (2) the spacing of the anchor sites 34 is not consistent with the established rib spacing; and (3) the accumulated effect of instances (1) and (2), supra.

The present invention provides a panel mounting clip assembly 36 (FIG. 2) which is capable of accommodating the spacing errors specified in items (1) through (3), supra. The clip assembly 36 includes a top clip 38 and a cooperating base member 40. The clip assembly 36 is adapted for interconnection with the longitudinal rib 26 which includes a crest 42, depending rib sidewalls 44, and spaced-apart inturned base portions 46 connecting the rib sidewalls 44 to adjacent ones of the panel webs 24. As will become apparent, the connection between the top clip 38 and the base member 40 allows the top clip to move laterally (e.g. along the X axis) relative to the stationary base member 40 thereby to accommodate any joint-to-clip and rib-to-clip misalignment. Furthermore, the connection allows limited universal movement of the top clip 38. That is, the top clip 38 may undergo (a) limited rotation about the vertical Y axis; (b) limited tilting generally about the horizontal X axis; (c) limited tilting generally about the horizontal Z axis; and (d) limited tilting generally about a point coincident with the intersection of the X and Z axes. The top clip motion about the X and Z axes accommodates any inherent or accidently formed distortions in the profile of the rib 26 or the panel components constituting the joint 153 (FIG. 9D).

Figure 3:
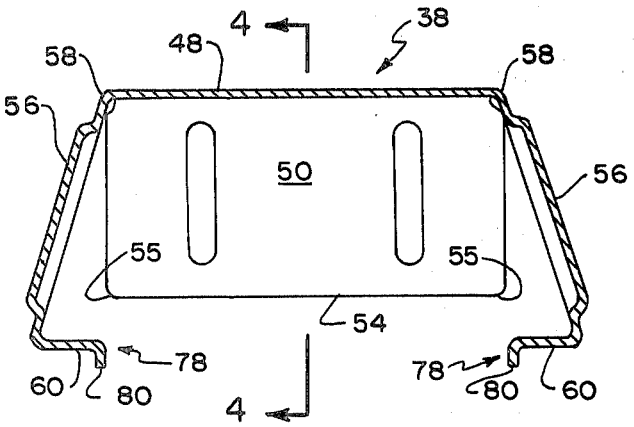
FIG. 3 is a cross-sectional view, taken along the line 3—3 of FIG. 4, illustrating a top clip.
Figure 4:
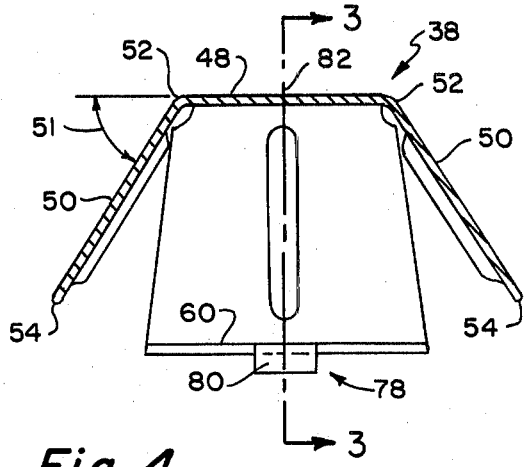
FIG. 4 is a cross-sectional view taken along the line 4—4 of FIG. 3.

Referring to FIGS. 3 and 4, the top clip 38 includes an upper wall 48 which may have a generally rectangular configuration. Clamping wings 50 depend from the opposite sides 52 of the upper wall 48 and terminate in clamping edges 54 positioned to engage interior surfaces of and extend generally parallel with the length of the longitudinal rib 26.

Each clamping wing 50 has rounded corners 55 (FIG. 3) at the ends of the clamping edge 54. The rounded corners 55 are preferred over sharp corners since sharp corners would have a tendency to bite into the rib 26 and inhibit thermal expansion and contraction of the rib 26. The clamping wings 50 diverge outwardly from the upper wall 48 (i.e., away from each other) toward the base member. Each of the clamping wings 50 is inclined at an angle indicated at 51 relative to the horizontal. In the illustrated embodiments, the angle 51 has a value of about 57.5 angular degrees. Connecting wings 56 depend from opposite ends 58 of the upper wall 48 and include terminal flanges 60 disposed below the level of the clamping edges 54 and are angularly presented relative to the connecting wings 56. The connecting wings 56 diverge outwardly from the upper wall 48 (i.e., away from each other) toward the base member 40 as illustrated in FIG. 8D. In the preferred embodiment, the terminal flanges 60 extend inwardly of the connecting wings 56 toward one another. The top clip 38 may be formed from spring steel having a thickness of from 18 gauge (1.214 mm) to about 22 gauge (0.760 mm).

Broadly, the base member 40 (FIG. 2) is adapted to be fastened to the panel support member 22 (FIG. 1) in fixed position relative thereto and preferably at the anchor site 34. The base member 40 provides spaced-apart opposite faces 62 which extend transversely of the clamping wings 50 and ultimately transversely of the length of the longitudinal rib 26. In the preferred embodiment, the base member 40 (FIGS. 2, 5 and 6) comprises a generally U-shaped clip including a web 64 having a central, fastener receiving opening 66; and upstanding widewalls 68, one adjoining each of the opposite longitudinal edges of the web 64. The sidewalls 68 present first adjacent end faces 62A and second adjacent end faces 62B (only one visible in FIG. 5) at opposite ends thereof. Each of the adjacent end faces 62A, 62B corresponds to one of the aforesaid opposite faces 62. The base member 40 may be formed from galvanized steel having a thickness of from 12 gauge (2.657 mm) to about 18 gauge (1.214 mm).

Figure 2:
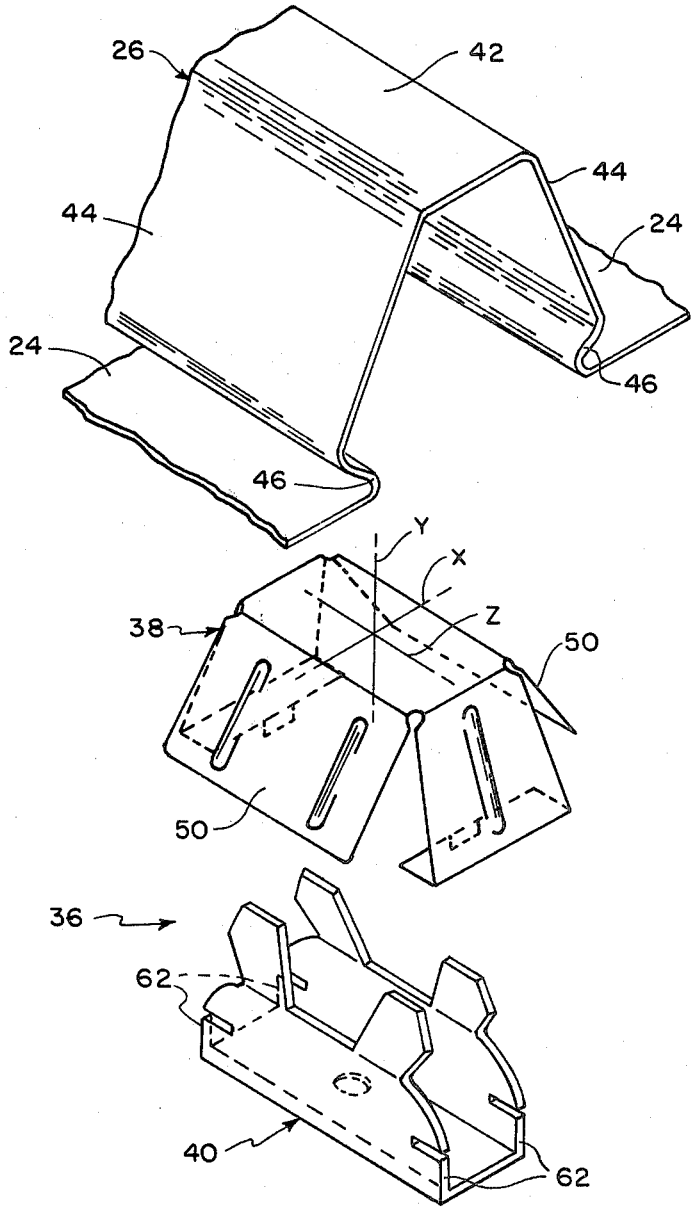
FIG. 2 is an isometric view, in exploded form, illustrating the panel mounting clip assemply of this invention in relation to a panel rib.

Guide means 70 associated with the adjacent end faces 62A, 62B is provided which, as will be described, receive the terminal flanges 60 and thereby connect the top clip 38 to the base clip 40 in moveable relationship to provide for movement of the top clip 38 transversely of the longitudinal rib 26. Broadly, the guide means 70 comprises coplanar upper surfaces 72 (FIG. 5) and spaced therefrom coplanar lower surfaces 74. Preferably, the distance between the coplanar upper surfaces 62 and the coplanar lower surfaces 74 is greater than the thickness of the terminal flanges 60 thereby to allow for limited tilting generally about the X axis (FIG. 2). In the preferred embodiment, the guide means 70 comprises slots 76, one at each end of each sidewall 68. Each of the slots 76 is open at the end faces 62A, 62B, and extends inwardly therefrom generally parallel with the web 64.

Referring to FIGS. 2–4, stop means 78 is provided for limiting movement of the top clip 38 relative to the base member 40. In the preferred arrangement, the stop means 78 comprises tabs 80, one depending downwardly from the inner end of each of the terminal flanges 60.

Figure 6:
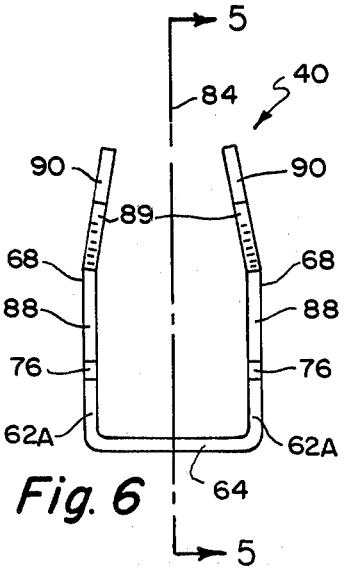
FIG. 6 is an end view of the base member of FIG. 5.
Figure 7:
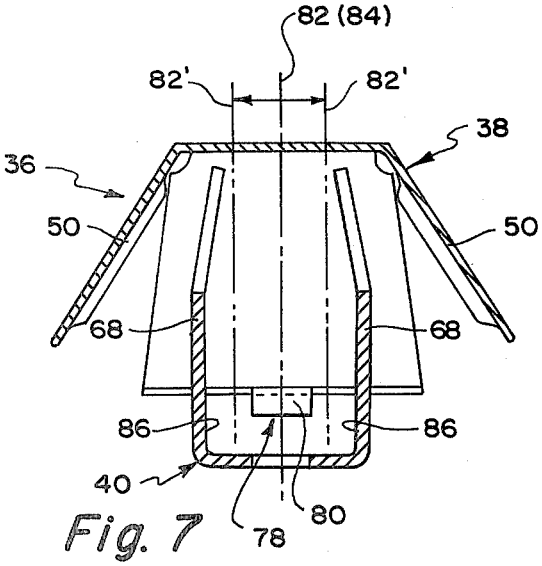
FIG. 7 is a cross-sectional view, taken along the same plane as FIG. 4, illustrating the top clip and the base member in assembled relation.

The top clip 38 (FIG. 4) possesses bilateral symmetry about a vertical plane indicated by the dash-dot line 82. The base member 40 (FIG. 6) possesses bilateral symmetry about a vertical plane indicated by the dash-dot line 84. When the top clip 38 is assembled on the base member 40 (FIG. 7), the vertical planes 82 (84) normally are coincident. The tabs 80 (only one visible) residing between the sidewalls 68 of the base member 40, are positioned to engage either of the inner faces 86 of the sidewalls 68, thereby limiting the transverse movement of the top clip 38 relative to the extreme positions represented by the dash-dot-dot vertical planes 82'.

Figure 5:
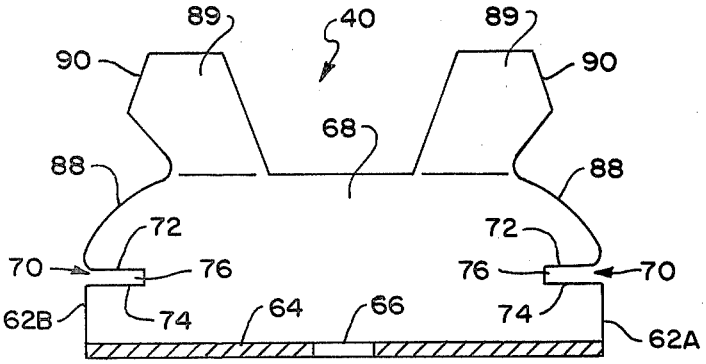
FIG. 5 is a cross-sectional view, taken along the line 5—5 of FIG. 6, illustrating a base member.

Referring to FIG. 5, each of the sidewalls 68 includes converging, upwardly convex guiding surfaces 88 at each end thereof which extend upwardly from the slots 76. As will be described, the guiding surfaces 88 are engaged by the inner edges of the terminal flanges 60 and serve to spread the connecting wings 56 during installation of the top clip 38 on the base member 40. Each of the sidewalls additionally includes opposite end edge segments 90 disposed above the guiding surfaces 88, and positioned to engage interior surfaces of the connecting wings 56.

FIGS. 8A through 8D illustrate the sequence of steps for attaching the panel mounting clip assembly 36 to the panel support member 22.

Figure 8A:
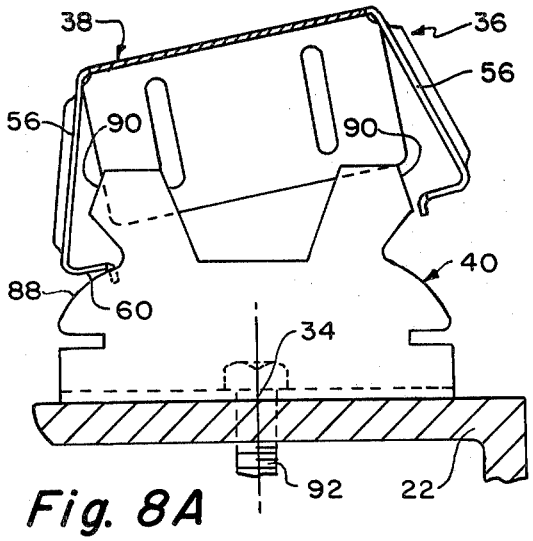
FIGS. 8A through 8D are cross-sectional views, illustrating installation of the top clip on the base member.
Figure 8B:
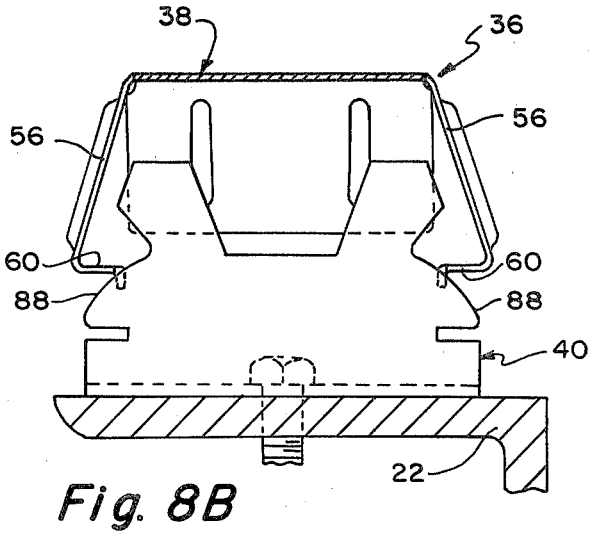
Figure 8C:
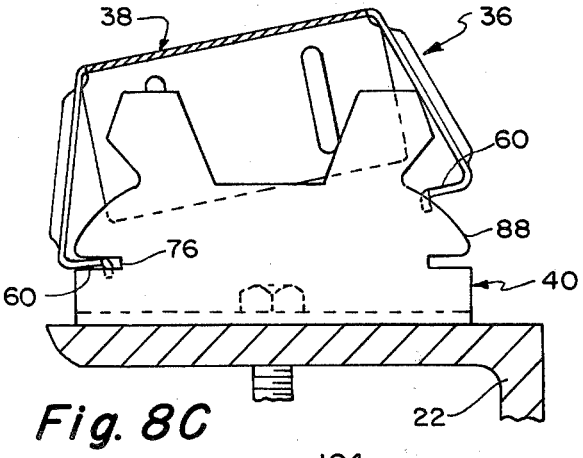
Figure 8D:
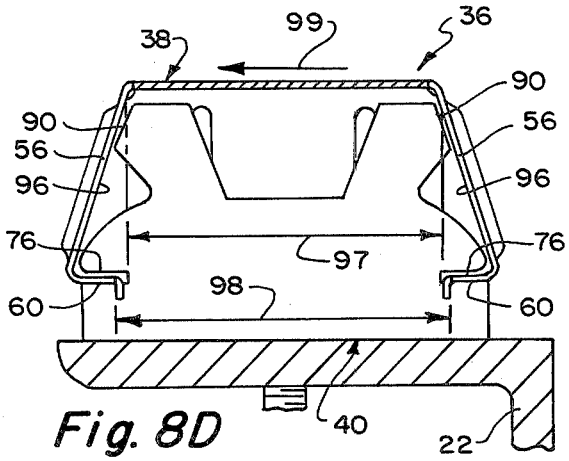

Referring to FIG. 8A, the base member 40 is rigidly secured to the panel support member 22—preferably at an anchor site 34—by any suitable fastening method, such as, the fastener 92 spot welding, riveting or the like. Thereafter, the top clip 38 is hooked over the edge segments 90 and is moved downwardly until, as shown in FIG. 8B, the inner edges of the terminal flanges 60 engage the guiding surfaces 88. The top clip 38 is tilted (FIG. 8C) and moved downwardly toward the base member 4 to introduce one of the terminal flanges 60 into the corresponding slot 76. The opposite side of the top clip 38 is pressed toward the base member 40. The opposite terminal flange 60 slides over the guiding surface 88 until the opposite terminal flange 60 engages the corresponding slot 76. The terminal flanges 60 reside within and are captively retained by the slots 76 as shown in FIG. 8D. It will be observed in FIG. 8D that the spacing 97 between the slots 76 is less than the spacing 98 between the confronting edges of the terminal flanges 60. The difference between the spacings 97, 98, and the difference between the thickness of the terminal flanges 60 and the depth of the slots 76 account for the limited universal movement of the top clip 38 about the X, Y and Z axes described above in connection with FIG. 2.

In FIG. 8D, the end edge segments 90 of the base upper portions 89 confront inner surfaces 96 of the connecting wings 56. If the panel mounting clip assembly 36 is used on a sloped roof, loads are applied to the top clip 38 by the weight of the attached panel member and by extrinsic loads, such as accumulated snow and the like. The applied loads tend to move the top clip 38 in a direction generally normal to the connecting wings 56, e.g., in the direction of the arrow 99. Such movement of the top clip 38 brings the right-hand connecting wing 56 into engagement with the end edge segments 90 thereby providing additional support for the applied loads.

FIGS. 9A through 9D illustrate the sequence of steps encountered in attaching a rib 26 of a panel member 20 to the panel mounting clip assembly 36. To illustrate the self-centering feature of the panel mounting clip assembly 36, it will be assumed that the vertical planes 82 (84) of the top clip 38 and base member 40 are coincident; and that the vertical plane 100 about which the rib 26 is symetrical, is offset from the planes 82 (84) by a distance indicated at 102. Such an offset can occur, as explained above, (1) by non-uniform spacing of the ribs 26; (2) by securing the clip assembly 36 at a location slightly offset from the desired anchor site 34; and (3) by the accumulated effect of items (1) and (2). Regardless of the reason for the offset 102, the self-centering feature of the present panel mounting clip assembly 36 readily accommodates the rib-to-clip misalignment.

Figure 9A:
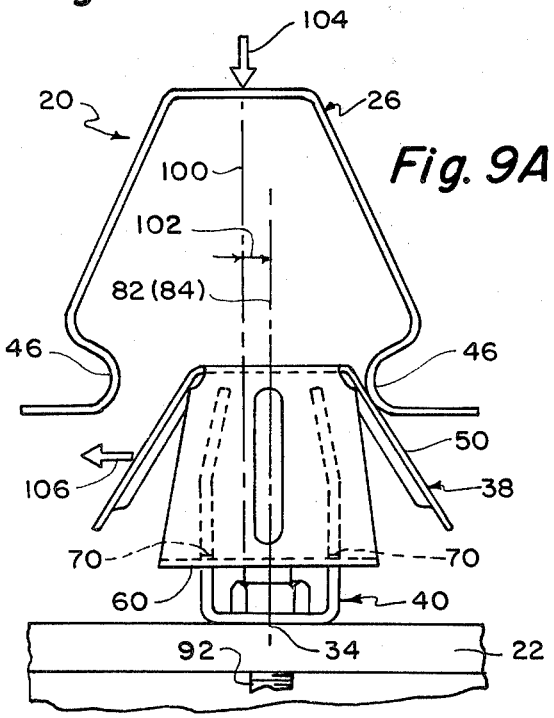
FIGS. 9A through 9D are end views, partly in cross-section illustrating attachment of a panel member to the present panel mounting clip assembly.
Figure 9B:
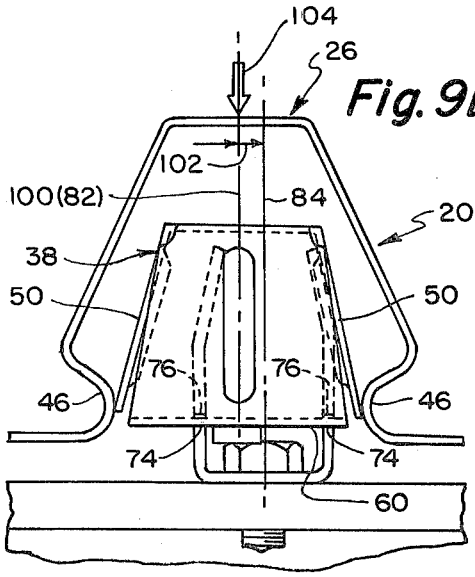
Figure 9C:
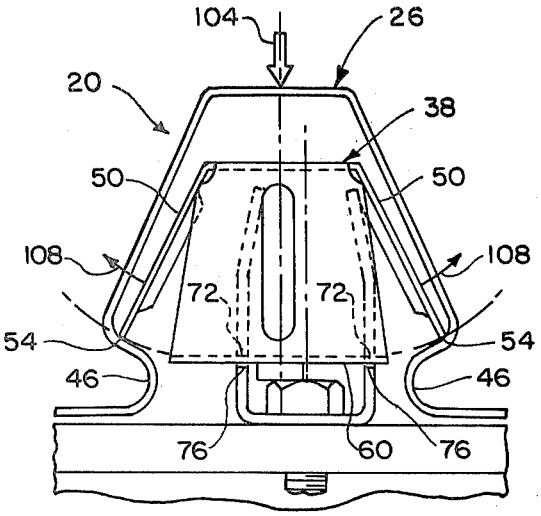
Figure 9D:
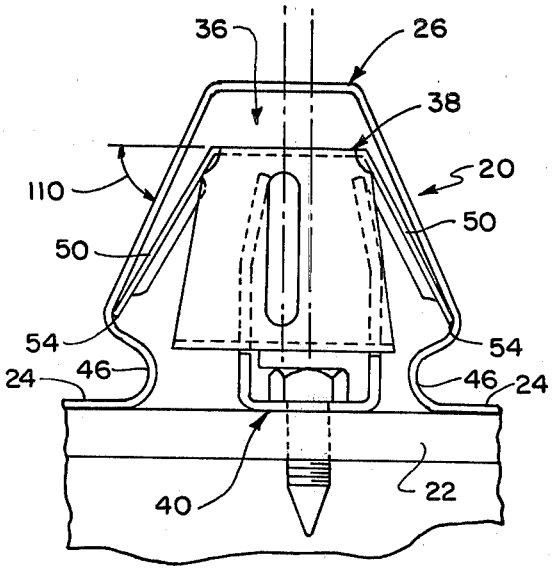

As shown in FIG. 9A, one of the inturned base portions 46 will engage the clamping wing 50. Forcing the rib 21 downwardly in the direction of the arrow 104 will cause the top clip 38 to move laterally in the direction of the arrow 106—the lateral movement being provided through cooperation of the guide means 70 and the terminal flanges 60. It will be observed by comparing FIGS. 9A and 9B, that the top clip 38 has moved laterally such that the vertical plane 82 thereof is coincident with the vertical plane 100—the coincident planes 100 (82) being offset from the vertical plane 84 of the base member 40 by the offset 102. Once the top clip 38 is centered with respect to the rib 26, the clamping wings 50 engage the inturned base portions 46 and are flexed inwardly thereby. At this time, the terminal flanges 60 rest on the coplanar lower surfaces 74 of the slots 76. When the rib 26 attains the lowered position illustrated in FIG. 9C, the clamping wings 50 are elastically urged outwardly and the clamping edges 54 slide upwardly over the interior surfaces of the inturned base portions 46. The top clip 38 is elevated so that the terminal flanges 60 engage the coplanar upper surfaces 72 of the slot 76. When the panel webs 24 engage the panel support member 22 (FIG. 9D), the top clip 38 is in its uppermost position relative to the base member 40. The connecting wings 50 continue to be elastically urged outwardly thereby urging the clamping edges 54 into frictional engagement with interior surfaces of the rib 26.

Figure 10:
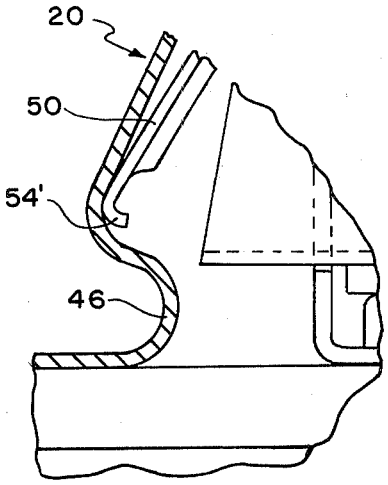
FIG. 10 is a fragment of FIG. 9D modified to illustrate an alternative configuration of the clamping edge.

It will be observed in FIG. 9D that the connecting wings 50 are inclined at an angle indicated at 110 relative to the horizontal—the angle 110 having a value of approximately 60 angular degrees. The clamping wings 50 normally are inclined at the angle 51 (e.g., about 57.5 angular degrees) when in the relaxed condition illustrated in FIG. 4. Since the angle 110 is greater than the relaxed angle 51, the wings 50 continue to be elastically urged into engagement with the rib 26, thereby clamping the inturned base portions 46 between the clamping edges 54 and the panel support member 22. It will be appreciated that even though the panel 20 is firmly attached to the panel support member 22 by the panel mounting clip assembly 36, the panel 20 still may undergo thermal expansion and contraction. It is recognized that during thermal expansion and contraction, the panel member 20 will move relative to the stationary top clip 38. Therefore it is contemplated that the remote outer edges of the clamping edges 54 be rounded throughout their length to insure surface-to-surface contact with the panel member 20 rather than an undesirable sharp edge-to-surface contact. Alternatively, as shown in FIG. 10, the clamping wings 50 (only one shown) may terminate in arcuate clamping edges 54'.

Alternative embodiments of the base member will now be described with reference to FIGS. 11 through 14. Corresponding numerals are employed to identify corresponding parts heretofore described.

Figure 11:
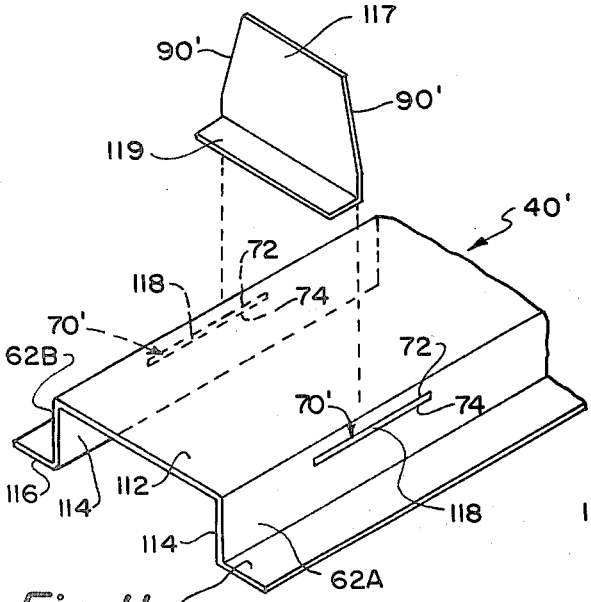
FIG. 11 is a fragmentary isometric view illustrating an alternative base member.

FIG. 11 illustrates a base member 40' comprising a hat-shaped member including an upper web 112, depending sidewalls 114 extending downwardly from each longitudinal edge of the upper web 112 and terminating in coplanar outwardly directed flanges 116. The sidewalls 114 present remote outer faces each corresponding to one of the aforesaid opposite faces 62A, 62B. The base member 40' may constitute each of the panel support members 22 of FIG. 1 or, alternatively, may constitute the well-known subgirt used in double-skin insulated roof and wall structures.

In this embodiment, the guide means 70' comprises slits 118, one provided in each of the sidewalls 114 adjacent to and extending generally parallel with the upper web 112. The slits 118 present the aforesaid coplanar upper surfaces 72 and the coplanar lower surfaces 74. It will be appreciated that sets of the slits 118 will be provided at spaced-apart locations along the length of the base member 40'—the center-to-center spacing of the sets of slits 18 corresponding substantially to the rib spacing 32 (FIG. 1). A diaphragm 117 is provided for each pair of slits 118. The diaphragm 117 includes a mounting flange 119 which is secured to the upper web 112. The diaphragm 117 presents opposite end edge segments 90' which serve the same function as the edge segments 90 (FIG. 8D).

Figure 12:
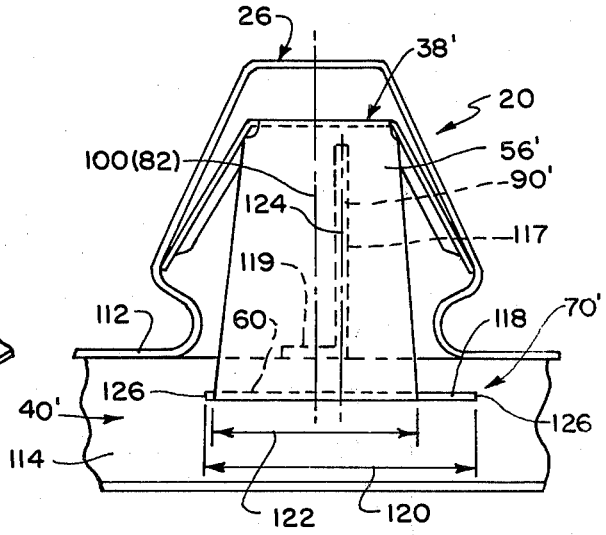
FIG. 12 is a fragmentary side view, similar to FIG. 9D, illustrating the use of the base member of FIG. 11.

FIG. 12 illustrates a rib 26 of a panel member 20 secured to the base member 40' by a top clip 38'. The top clip 38' includes connecting wings 56' straddling the sidewalls 114 and having the terminal flanges 60 thereof extending through the slits 118. The slit 118 has a length indicated at 120 which is greater than the length indicated at 122 of the terminal flange 60; and that the slits 118 possess bilateral symmetry about a vertical plane 124. The guide means 70' receives the terminal flanges 60 thereby connecting the top clip 38' to the base member 40' in moveable relationship to provide for movement of the top clip 38' longitudinally of the base member 40', that is transversely of the length of the rib 26. Where the rib 26 is misaligned with respect to the vertical plane 124, the top clip 38' moves laterally to the left (in FIG. 12) such that the vertical plane 82 thereof is coincident with the vertical plane 100 of the rib 26. It will also be observed in FIG. 12 that the top clip 38' is moveable in either direction along the entire length 120 of the slits 118 and will abut either of the ends 126. The opposite ends 126 therefore constitute the aforesaid stop means which limit the movement of the top clip 38' relative to the base member 40'. The diaphragm 117 preferably is positioned on the upper web 112 such that it contains the vertical plane 124. The end edge segments 90' are thus positioned to engage the connecting wings 56' when, as explained above, loads applied to the panel member 20 distort the top clip 38'.

Figure 13:
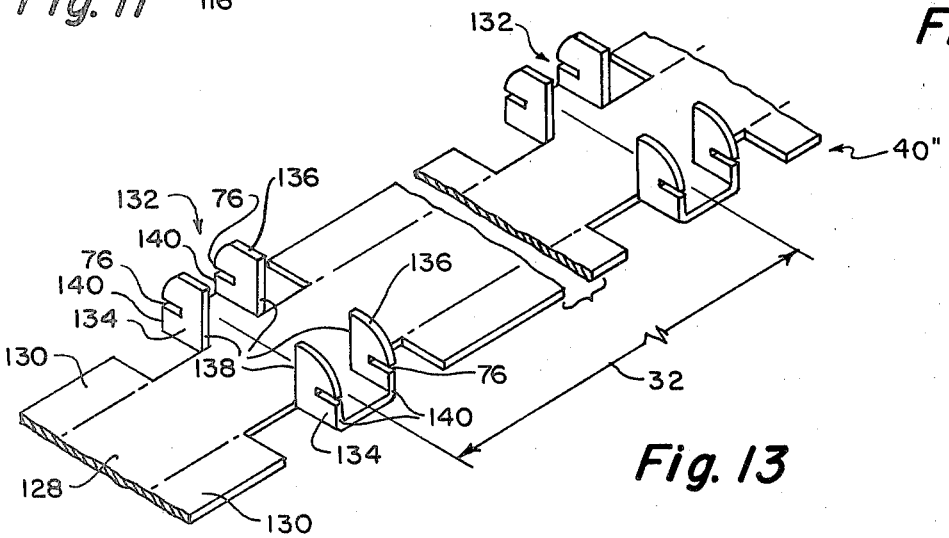
FIG. 13 is a fragmentary, broken isometric view of an alternative base member.

FIG. 13 illustrates a base member 40'' comprising an elongated plate 128 presenting opposite longitudinal edge portions 130. Sets 132 of tabs are provided at spaced locations along the length of the plate 128. The center-to-center spacing of the sets 132 corresponds substantially to the aforesaid rib spacing 32.

Each of the sets 132 comprises upstanding first tabs 132, one provided at each of the edge portions 130 and extending transversely of the plate 128; and upstanding second tabs 136, one provided at each of the edge portions 130 and extending transversely of the plate 128. In the preferred arrangement, the first tabs 134 and the second tabs 136 reside in separate generally parallel planes which are normal to the plate 128 and spaced-apart from each other. The tabs 134, 136 present confronting tab edges 138 and remote tab edges 140. The aforesaid guide means comprises the slots 76 which preferably are open at the remote tab edges 140 and extend inwardly thereof. In the preferred arrangement, each of the tabs 134, 136 comprises a segment of the plate 128 which is cut from and bent upwardly from the general plane of the plate 128. Each of the sets 132 will cooperate with one of the top clips 38 (FIG. 2) to provide the present panel mounting clip assembly. The base member 40'' finds utility as a subgirt element in insulated and uninsulated roof and wall structures.

Figure 14:
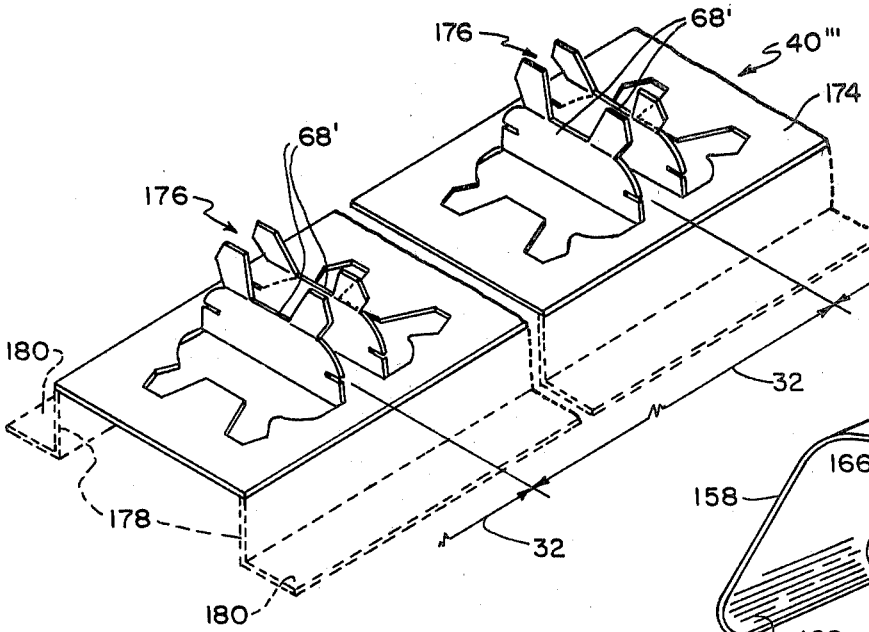
FIG. 14 is a fragmentary, broken isometric view of an alternative base member.

FIG. 14 illustrates a base member 40''' comprising a plate 174 from which segments are cut and bent upwardly to provide sets 176 of upstanding sidewalls 68'. The sidewalls 68' of each set 176 are substantially identical to the sidewalls 68 described above and illustrated in FIG. 5 and 6. The sets 176 are provided at a center-to-center distance corresponding to the aforesaid rib spacing 32. The top clips 38 (not shown) may be installed on the sidewalls 68' in the factory, thereby eliminating the step of fastening the base member 40 to the support member, as explained above. In this embodiment, as in the embodiment of FIG. 13, complete panel mounting clip assemblies are provided.

As a further alternative, the plate 174 may constitute the upper web of a hat-shaped panel support member—the depending sidewalls 178 and outwardly extending flanges 180 thereof being shown in dotted outline.

Figure 15:
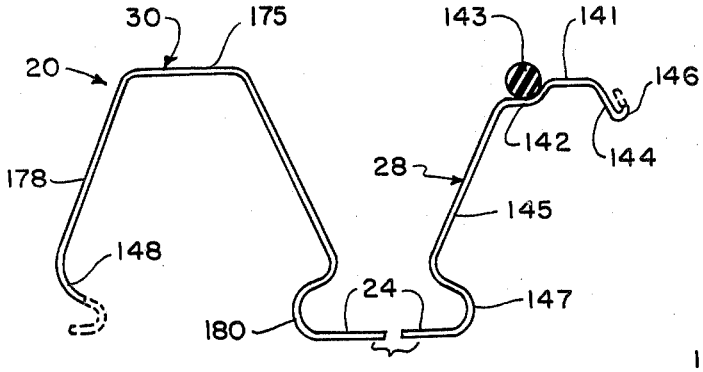
FIG. 15 is a broken end view of the panel member illustrated in FIG. 1.

FIG. 15 illustrates the male and female partial ribs 28, 30 of the panel member 20. In the following description, the terms "inner" and "outer" define the positions of the elements in the completed joint. The male partial rib 28 includes an inner crest 141; an inner sidewall 145; a step or shoulder connecting the sidewall 145 to one edge of the crest 141; a first inturned base portion connecting the sidewall 145 to the adjacent panel web 24; and a partial sidewall 144 terminating in a reverse turned flange 146. A bead 143 of sealant material is applied along the entire length of the shoulder 142. The female partial rib 30 includes an outer crest 175; first and second outer sidewalls, one depending from each of the opposite sides of the crest 175; an arcuate hug edge 148 at the lower edge of the second sidewall 178; and a second inturned base portion 180 connecting the first sidewall to the adjacent panel web 24. As shown in dotted outline, either or both of the reverse turned flange 146 and the hug edge 148 may be extended thereby serving as runout in the event the sheet girth exceeds the specified girth.

Figure 16A:
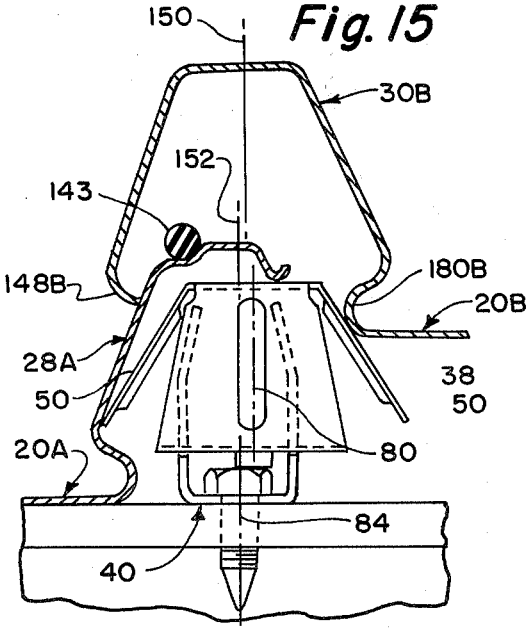
FIGS. 16A and 16B are fragmentary elevation views, similar to FIG. 9D, illustrating the formation of a joint between adjacent ones of the panel members of FIG. 15 and connected to the panel mounting clip assembly.
Figure 16B:
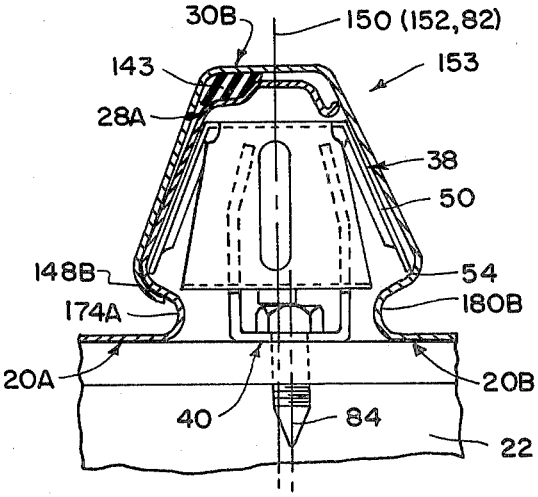

FIGS. 16A and 16B illustrate the manner of forming a joint between a first-installed panel member 20A and an adjacent panel member 20B. It will be observed in FIG. 16A that the top clip 38 has been displaced laterally to the right by the male partial rib 28A—the vertical plane 82 of the top clip 38 being displaced from the vertical plane 84 of the base member 40. In this position, the clamping wings 50 are in their normal, unstressed inclined positions. The female partial rib 30B is positioned such that the hug edge 148B engages the male partial rib 28A and such that the second inturned base portion 180B engages the clamping wing 50. The female partial rib 30B possesses a central vertical plane 150 which will ultimately be coincident with the vertical central plane 152 of the male partial rib 28A. As the female partial rib 30B is pressed downwardly, the wings 50 are elastically urged inwardly toward one another and the top clip 38 is moved laterally to the left of the position shown in full lines in FIG. 16A. Ultimately, the female partial rib 30B is fully engaged with the male partial rib 28A to form a joint 153 illustrated in FIG. 16B. The hug edge 148B is engaged around the first inturned base portion 147A at one side of the joint 153 whereas at the opposite side of the joint 153, the second inturned base portion 180B is clamped between the clamping edge 54 and the panel support member 22. In the final joint, the vertical planes 150 (152, 82) are coincident. For the purpose of illustration, the vertical plane 84 of the base member 40 is shown offset from the vertical planes 150 (152, 82) indicating that there is a slight joint-to-clip misalignment.

Figure 17:
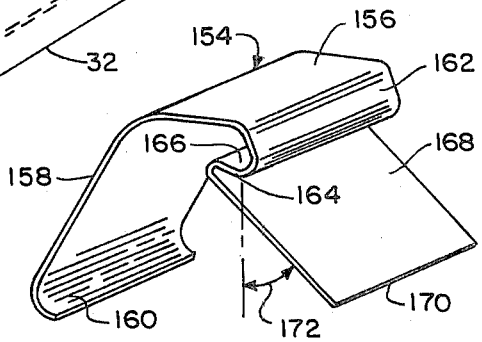
FIG. 17 is an isometric view of a supplemental clip.

Referring to FIG. 1, the present invention also provides joint retention clips 154 (only one illustrated) which are installed over the male partial rib 28 at spaced-apart locations between adjacent panel support members 22. The clip 154 (FIG. 17) includes a top wall 156 having a clip sidewall 158 depending from one longitudinal edge thereof and terminating in an arcuate hug edge 160. A wall segment 162 depends from the opposite longitudinal edge of the top wall 156 and cooperates with an inturned wall segment 164 to define a groove 166. A second wall segment 168 adjoining the inturned wall segment 164, is inclined downwardly and outwardly therefrom and terminates in a clamping edge 170. The clip 154 may be formed from spring steel having, for example, a thickness of 24 gauge (0.607 mm). The thickness of the clip 154 should correspond to the clearance between partial ribs 28, 30 in the joint 153. In a relaxed condition, the second sidewall 168 is inclined at an angle 172 relative to the vertical. The angle 172 may have a value of about 50 angular degrees.

Figure 18:
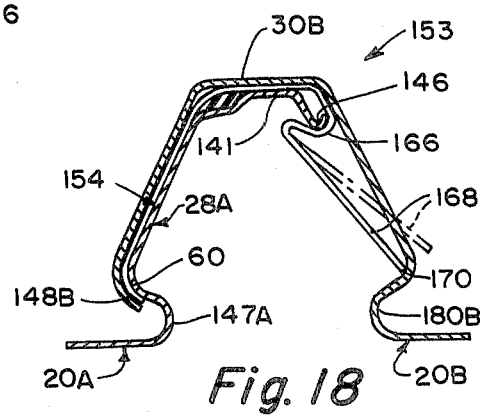
FIG. 18 is a fragmentary, transverse cross-sectional view, illustrating installation of the supplemental clip at the joint between adjacent ones of the building panels of FIG. 15.

FIG. 18 illustrates one of the clips 154 at the joint 153. The clip 154 is installed over the male partial rib 28A such that the hug edge 160 engages the first inturned base portion 147A and such that the reverse turned flange 146 resides within the groove 166. When the female rib 30B of the adjacent panel member 20B is installed, the clip 154 is enclosed therewithin. The second wall segment 168 is flexed from the normally relaxed position illustrated in dash-dot outline to the stressed position illustrated in full lines. The clamping edge 170 of the second sidewall segment 168 is resiliently urged into frictional engagement with an interior surface of the female partial rib 30B. A plurality of the joint retention clips 154 are provided between adjacent panel support members 22 and at intervals of from 12 inches (30.5 cm) to about 18 inches (45.7 cm). The joint retention clips 154 maintain the interlocked partial ribs 28, 30 in registration and assure a positive weather seal.

What is claimed is:

1. A panel mounting clip assembly for interconnection with a longitudinal rib of a panel member and for attaching the panel member to a panel support member, comprising:

a top clip having an upper wall, clamping wings depending from opposite sides of said upper wall and terminating in clamping edges engageable with interior surfaces extending lengthwise of the longitudinal rib, and connecting wings depending from opposite ends of said upper wall and including terminal flanges disposed below the level of said clamping edges and angularly presented relative to said connecting wings;

a base member including spaced-apart opposite faces extending transversely of said clamping edges;

guide means associated with said opposite faces and receiving said terminal flanges, connecting said top clip to said base member for free movement relative to said base member and in a direction transversely of said clamping edges; and stop means limiting the extent of said free movement of said top clip relative to said base member.

2. The panel mounting clip assembly of claim 1 wherein said terminal flanges extend inwardly of said connecting wings toward one another.

3. The panel mounting clip assembly of claim 1 or 2 wherein said guide means comprises coplanar upper surfaces and spaced therefrom coplanar lower surfaces, the distance between said upper surfaces and said lower surfaces being greater than the thickness of said terminal flanges.

4. The panel mounting clip assembly of claim 1 or 2 wherein guide means comprises:

slot means in each of said opposite faces receiving said terminal flanges.

5. The panel clip assembly of claim 1 or 2 wherein said connecting wings diverge outwardly from said upper wall toward said base member; and wherein said clamping wings diverge outwardly from said upper wall toward said base member.

6. The panel clip assembly of claim 1 wherein said top clip is formed from spring steel.

7. The panel mounting clip assembly of claim 1 wherein said base member comprises a U-shaped clip including a web and upstanding sidewalls disposed between said clamping wings and presenting first adjacent end faces and second adjacent end faces at opposite ends thereof, each said adjacent end faces corresponding to one of said opposite faces; and said guide means comprises slots, one at each end of each sidewall, said slots being open at said end faces and extending inwardly thereof generally parallel with said web.

8. The panel mounting clip assembly of claim 7 wherein each of said sidewalls includes converging convex guiding surfaces at each end thereof extending upwardly from said slots.

9. The panel mounting clip assembly of claim 8 wherein each of said sidewalls includes opposite end edge segments above said guiding surfaces positioned to engage interior surfaces of said connecting wings.

10. The panel mounting clip assembly of claim 1 wherein said base member comprises a hat-shaped member including an upper web, depending sidewalls extending downwardly from each longitudinal edge of said upper web and terminating in coplanar outwardly directed flanges; and said guide means comprises slits in said depending sidewalls adjacent to and generally parallel with said web, the length of said slits being greater than the length of said terminal flanges.

11. The panel mounting clip assembly of claim 1 or 2 wherein said base member comprises an elongated plate having opposite longitudinal edge portions, and sets of tabs at spaced locations along the length of said plate; each of said sets comprising upstanding first tabs, one at each of said edge portions and extending transversely of said plate; upstanding second tabs, one at each of said edge portions, extending transversely of said plate and being spaced-apart from the adjacent one of said first tabs; said tabs presenting confronting tab edges and remote tab edges;

one said top clip being provided for each of said sets of tabs; and said guide means comprising slots, one in each tab of each of said sets, said slots being open at said tab edges and extending inwardly thereof.

12. The panel mounting clip assembly of claim 11 wherein said tab edges comprise said remote tab edges.

13. The panel mounting clip assembly of claim 11 wherein said first tabs and said second tabs reside in separate generally parallel planes which are normal to said plate.

14. The panel mounting clip assembly of claim 11 wherein each of said tabs comprises a segment of said plate which is cut from said plate and bent upwardly from the general plane of said plate.

15. The panel mounting clip assembly of claim 1 or 2 wherein said base member comprises an elongated plate having sets of generally parallel, upstanding sidewalls at spaced locations along the length thereof; the upstanding sidewalls of each of said sets extending transversely of said plate and presenting first adjacent end faces and second adjacent end faces at opposite ends thereof, each said adjacent end faces corresponding to one of said opposite faces;

one said top clip being provided for each of said sets; and said guide means comprising slots, one at each end of each sidewall of each set, said slots being open at said end faces and extending inwardly thereof generally parallel with said plate.

16. The panel mounting clip assembly of claim 15 wherein each of said sidewalls comprises a segment of said plate which is cut from said plate and bent upwardly from the general plane of said plate.

17. In a roof or wall structure having horizontally extending panel support members, the combination of a plurality of panel members extending transverse of said panel support members and being erected in side-by-side edge interlocked relation, each of said panel members comprising alternating panel webs and upstanding longitudinal ribs, each of said ribs comprising a crest, depending rib sidewalls, and spaced-apart inturned base portions connecting said rib sidewalls to adjacent ones of said panel webs; and panel mounting clip assemblies, one connecting each of said ribs to said panel support member, each of said assemblies including a top clip disposed within the rib and including clamping wings extending generally parallel with the rib and having clamping edges engaging said inturned base portions, and connecting wings extending transversely of the rib and terminating in terminal flanges below the level of said clamping edges and angled relative to said connecting wings; a base member secured to said support member and including spaced-apart generally parallel, opposite faces extending transversely of said clamping wings; guide means associated with said opposite faces receiving said terminal flanges thereby connecting said top clip to said base member in moveable relationship to provide for movement of said top clip transversely of said base member into registry with the rib; and stop means limiting movement of said top clip relative to said base member.

18. The roof or wall structure of claim 17 wherein said terminal flanges extend inwardly of said connecting wings toward one another.

19. The roof or wall structure of claim 17 or 18 wherein said guide means comprises coplanar upper surfaces and spaced therefrom coplanar lower surfaces, the distance between said upper surfaces and said lower surfaces being greater than the thickness of said terminal flanges.

20. The roof or wall structure of claim 17 or 18 wherein said guide means comprises slot means in each of said opposite faces receiving said terminal flanges.

21. In a rib-like joint formed by a male partial rib and an overlapping female partial rib of adjacent panels, the combination comprising: said female partial rib including an outer crest, first and second outer sidewalls, one depending from each edge of said outer crest, and a first inturned base portion connecting the first outer sidewall to a panel web of one panel member; said male partial rib including an inner crest adjacent to said outer crest, an inner sidewall depending from one edge of said inner crest and engaged with the second outer sidewall, and a second inturned base portion connecting said inner sidewall to a panel web of the other panel members; and a panel mounting clip assembly connecting said joint to a panel support member, said assembly including a top clip disposed between said inner sidewall and the first outer sidewall and including clamping wings extending generally parallel with said joint and having clamping edges engaging the first and second inturned base portions, and connecting wings extending transversely of said joint and terminating in terminal flanges below the level of said clamping edges and angled relative to said connecting wings; a base member secured to said support member and including spaced-apart generally parallel, opposite faces extending transversely of said joint; guide means associated with said opposite faces receiving said terminal flanges thereby connecting said top clip to said base member in movable relationship to provide for movement of said top clip transversely of said base member into registry with said joint; and stop means limiting movement of said top clip relative to said base member.

22. The rib-like joint of claim 21 wherein said second sidewall terminates in an arcuate hug edge engaging said first inturned base portion.

23. The rib-like joint of claim 21 or 22 including a shoulder connecting said inner sidewall to said inner crest and being spaced-apart from said outer crest; and a bead of sealant material compressed between said shoulder and said outer crest.

24. In a rib-like joint formed by a male partial rib and an overlapping female partial rib of adjacent panel members, the combination comprising: said female partial rib comprising an outer crest, first and second outer sidewalls, one depending from each edge of said outer crest, the second outer sidewall terminating in an arcuate hug edge, and a first inturned base portion connecting the first outer sidewall to a panel web of one panel member; said male partial rib comprising an inner crest adjacent to said outer crest, an inner sidewall depending from one edge of said inner crest adjacent to the second outer sidewall, a second inturned base portion connecting said inner sidewall to a panel web of the other panel member, and a partial sidewall depending from the other edge of said inner crest adjacent to the fist outer sidewall; and a joint retention clip including a top wall residing between said outer crest and said inner crest, a clip sidewall depending from one edge of said top wall and residing between the second outer sidewall and said inner sidewall, and terminating in an arcuate hug edge disposed between the first said arcuate hug edge and said first inturned base portion, a wall segment depending from the other edge of said top wall adjacent to the first outer sidewall, an inturned wall segment adjoining a remote edge of and cooperating with said wall segment to define a groove receiving said partial sidewall, and a second wall segment adjoining said inturned wall segment and terminating in a clamping edge, said second wall segment being elastically urged toward the second outer sidewall with said clamping edge engaged with an interior surface of said female partial rib.

25. The rib-like joint of claim 24 wherein said clip is formed from spring steel.

26. A panel mounting clip assembly for interconnection with a longitudinal rib of a panel member and for attaching the panel member to a panel support member, comprising:

a top clip having an upper wall including opposite sides and opposite ends, and clamping wings depending from said opposite sides and terminating in generally parallel clamping edges engageable with interior surfaces of the longitudinal rib;

a base member; and connecting means distinct from said clamping wings and contiguous with said opposite ends of said upper wall, connecting said top clip to said base member for limited, substantially ree movement relative thereto, generally parallel with said upper wall and transversely of said clamping edges.

27. In a roof or wall structure having horizontally extending panel support members, the combination of a plurality of panel members extending transversely of said panel support members and being erected in side-by-side edge interlocked relation, each of said panel members comprising alternating panel webs and upstanding longitudinal ribs, each of said ribs comprising a crest, depending rib sidewalls, and spaced-apart inturned base portions connecting said rib sidewalls to adjacent ones of said panel webs; and panel mounting clip assemblies, one connecting each of said ribs to said panel support member, each of said assemblies including a top clip disposed within the rib and including clamping wings extending generally parallel with the rib and having clamping edges engaging said inturned base portions; a base member; and connecting means distinct from said clamping wings connecting said top clip to said base member for limited, substantially free movement longitudinally of said panel support member and into registry with the longitudinal rib.

* * * * *